US010975729B2

(12) United States Patent
Kusakabe

(10) Patent No.: US 10,975,729 B2
(45) Date of Patent: Apr. 13, 2021

(54) GAS TURBINE ENGINE

(71) Applicant: HONDA MOTOR CO., LTD., Tokyo (JP)

(72) Inventor: Yukio Kusakabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 37 days.

(21) Appl. No.: 16/589,335

(22) Filed: Oct. 1, 2019

(65) Prior Publication Data

US 2020/0141280 A1 May 7, 2020

(30) Foreign Application Priority Data

Oct. 4, 2018 (JP) ..... JP2018-189040

(51) Int. Cl.
*F01D 25/24* (2006.01)

(52) U.S. Cl.
CPC ..... *F01D 25/243* (2013.01); *F05D 2240/14* (2013.01)

(58) Field of Classification Search
CPC ..... F01D 25/243; F01D 25/16; F01D 21/045; F05D 2220/38; F05D 2240/14; F05D 2260/38; F05D 2260/39
USPC ..... 415/214.1
See application file for complete search history.

(56) References Cited

U.S. PATENT DOCUMENTS 6,009,701 A * 1/2000 Freeman ..... F01D 21/045 60/223
6,829,883 B2 * 12/2004 Sathianathan ..... F01D 25/243 60/223
7,195,444 B2 * 3/2007 Brault ..... F01D 21/045 60/223
7,237,959 B2 * 7/2007 Bouchy ..... F01D 21/045 384/445
7,318,685 B2 * 1/2008 Bouchy ..... F01D 21/045 403/2
7,322,180 B2 * 1/2008 Lapergue ..... F01D 21/045 60/226.1
7,452,152 B2 * 11/2008 Bouchy ..... F01D 21/045 403/2

(Continued)

FOREIGN PATENT DOCUMENTS

FR 2752024 A1 * 2/1998 ..... F01D 21/045
FR 2831624 A1 * 5/2003 ..... F01D 21/045

(Continued)

*Primary Examiner* — Thai Ba Trieu
(74) *Attorney, Agent, or Firm* — Armstrong Teasdale LLP

(57) ABSTRACT

A gas turbine engine includes: an engine case; an engine rotation shaft rotatably supported by the engine case via a bearing member; a first flange extending from the engine case to define a first annular contact surface facing in an axial direction; and a bearing case having an inner end supporting the bearing member and a second flange defining a second annular contact surface that coaxially contacts the first annular contact surface. The second flange is joined to the first flange so as to be movable radially relative to the first flange when applied with a load greater than or equal to a predetermined value in a direction to move the second flange radially relative to the first flange. An outer circumferential edge of one of the first and second flanges is provided with an opposing piece opposing an outer circumferential edge of the other via a radial gap.

8 Claims, 6 Drawing Sheets

(56) References Cited

U.S. PATENT DOCUMENTS

| | | | | |
|---|---|---|---|---|
| 2005/0254945 | A1 | 11/2005 | VanDuyn | |
| 2006/0110244 | A1* | 5/2006 | Brault | F01D 21/045 415/110 |
| 2013/0149139 | A1* | 6/2013 | Wallace | F01D 21/045 415/214.1 |
| 2017/0114656 | A1* | 4/2017 | Gallimore | F01D 25/16 |

FOREIGN PATENT DOCUMENTS

| | | | | |
|---|---|---|---|---|
| FR | 2832195 | A1 * | 5/2003 | F01D 21/045 |
| FR | 2888621 | A1 * | 1/2007 | F01D 21/045 |
| JP | 2005325837 | | 11/2005 | |
| JP | 4818694 | B | 11/2011 | |

* cited by examiner

GAS TURBINE ENGINE

TECHNICAL FIELD

The present invention relates to a gas turbine engine, and more specifically relates to a turbo-fan gas turbine engine for aircraft.

BACKGROUND ART

In turbofan engines for aircraft, if foreign objects such as birds and hail (hailstones) collide with the fan (front fan) disposed in the air inlet of the engine casing (cowl), the resulting impact and/or damage of the fan blades caused by the collision with the foreign objects (Foreign Object Damage (FOD)) may generate an imbalance load, and the imbalance load may cause an excessive load to act on the bearing system of the fan, rotor shaft, etc.

As a fail-safe measure at the time of FOD of the fan blades, it is known to provide a fuse (or decoupling) mechanism comprising rupture screws in the bearing system of the fan (JP4818694B, for example) or to provide a fuse mechanism comprising a fusible link provided in the junction between the case assembly members (JP2005-325837A, for example).

However, it is often difficult to adopt the prior art fuse mechanism comprising the rupture screws or the fusible link between the case assembly members due to the restriction imposed by the engine layout or the like, or the adoption of the fuse mechanism tends to result in an increase in the engine size and/or a change in the engine layout.

SUMMARY OF THE INVENTION

A primary object of the present invention is to provide a gas turbine engine provided with a fuse mechanism serving as a fail-safe mechanism at the time of FOD of the fan blades or the like without requiring an increase in the engine size or a change in the engine layout.

To achieve the above object, one embodiment of the present invention provides a gas turbine engine (10), comprising: an engine case (14); an engine rotation shaft (20) rotatably supported by the engine case via a bearing member (16); a first flange (102) extending from the engine case to define a first annular contact surface (103) facing in an axial direction; and a bearing case (104) having an inner end (106) supporting an outer circumference side of the bearing member (16) and a second flange (108) defining a second annular contact surface (109) that coaxially contacts the first annular contact surface (103), wherein the second flange is joined to the first flange such that the second flange can move radially relative to the first flange when applied with a load greater than or equal to a first predetermined value in a direction to move the second flange radially relative to the first flange, and an outer circumferential edge of one of the first flange and the second flange is provided with an opposing piece (120) that opposes an outer circumferential edge of another of the first flange and the second flange via a radial gap.

According to this arrangement, if a large imbalance load acts on the rotor at the time of FOD of the fan blades or the like and the load acting on the second flange overcomes the fastening force exerted by the bolts and the nuts (or the frictional resistance between the first flange and the second flange resulting from the fastening force), the second flange moves radially relative to the first flange against the frictional resistance. This relative radial movement absorbs (consumes) the energy of the imbalance load. Further, as the radial movement proceeds further, the opposing piece provided on the outer circumferential edge of one of the first flange and the second flange comes into contact with and is pressed by the outer circumferential edge of the other of the first flange and the second flange. This causes the opposing piece to deform and the opposing piece may eventually break away from the second flange. Owing to the deformation and breakage of the opposing piece, further absorption (consumption) of the energy of the imbalance load takes place. Thus, a fuse mechanism is constituted at a joint between the engine case and the bearing case without need for an additional member, and therefore, the fuse mechanism does not require an increase in the engine size and a change in the engine layout.

Preferably, the opposing piece (120) is formed of a bent piece that is bent from the outer circumferential edge of the one of the first flange (102) and the second flange (108) in the axial direction.

According to this arrangement, the opposing piece can be formed without need for a special additional component. Also, it is possible to provide the opposing piece with a bending stiffness necessary as a fuse mechanism.

Preferably, the opposing piece (120) is divided into multiple parts in a circumferential direction by multiple cutouts (122) provided at multiple positions in the circumferential direction.

According to this arrangement, the bending stiffness of the opposing piece can be set to an appropriate value by appropriately selecting the number of cutouts and/or the dimensions of each cutout.

Preferably, the first flange (102) and the second flange (108) are joined to each other by means of bolts (116) axially passed through bolt through-holes (112, 114) formed in each of the first flange and the second flange and nuts (118) fastened to the respective bolts, and the bolt through-holes (112, 114) formed at least one of the first flange and the second flange are oblong holes that are oblong in a radial direction.

According to this arrangement, the second flange can be joined to the first flange so as to be movable in the radial direction with a simple structure.

Preferably, the first flange (102) and the second flange (108) are joined to each other by means of bolts (116) axially passed through bolt through-holes (112, 114) formed in each of the first flange and the second flange and nuts (118) fastened to the respective bolts, the bolt through-holes (112, 114) formed in one of the first flange and the second flange are oblong holes that are oblong in a radial direction, and the bolt through-holes (112, 114) formed in another of the first flange and the second flange are circular holes having a substantially same diameter as that of the bolts.

According to this arrangement, the second flange can be joined to the first flange so as to be movable in the radial direction with a simple structure.

Preferably, an amount of radial play produced between the first flange (102) and the second flange (108) when a load greater than or equal to the first predetermined value overcomes a fastening force exerted by the bolts (116) and the nuts (118) is greater than a radial gap between the opposing piece (120) and an outer circumferential edge of the other of the first flange (102) and the second flange (108) that opposes the opposing piece.

According to this arrangement, it is ensured that the opposing piece undergoes deformation to absorb energy before the bolts break.

Preferably, the gas turbine engine further comprises a shear pin (130) that connects the first flange (102) and the second flange (108) in an initial state position and breaks when the second flange is applied with a load greater than or equal to a second predetermined value in a direction to move the second flange radially relative to the first flange, the second predetermined value being equal to or slightly smaller than the first predetermined value.

According to this arrangement, in a steady state in which the second flange is not applied with a load greater than or equal to the second predetermined value in a direction to move the second flange radially relative to the first flange, the initial state position of the first flange and the second flange can be set uniquely by the shear pin, and the second flange is prevented from moving undesirably relative to the first flange. Because the shear pin breaks when the second flange is applied with a load greater than or equal to the second predetermined value in a direction to move the second flange radially relative to the first flange and the second predetermined value is equal to or slightly smaller than the first predetermined value, the shear pin does not hinder the function of the fuse mechanism.

Thus, in the gas turbine engine according to one embodiment of the present invention, a fuse mechanism can be constituted at a joint between the engine case and the bearing case without need for an additional member, and therefore, the fuse mechanism does not require an increase in the engine size and a change in the engine layout.

DESCRIPTION OF THE PREFERRED EMBODIMENT(S)

In the following, one embodiment of a gas turbine engine according to the present invention will be described with reference to FIGS. 1 to 4.

Figure 1:
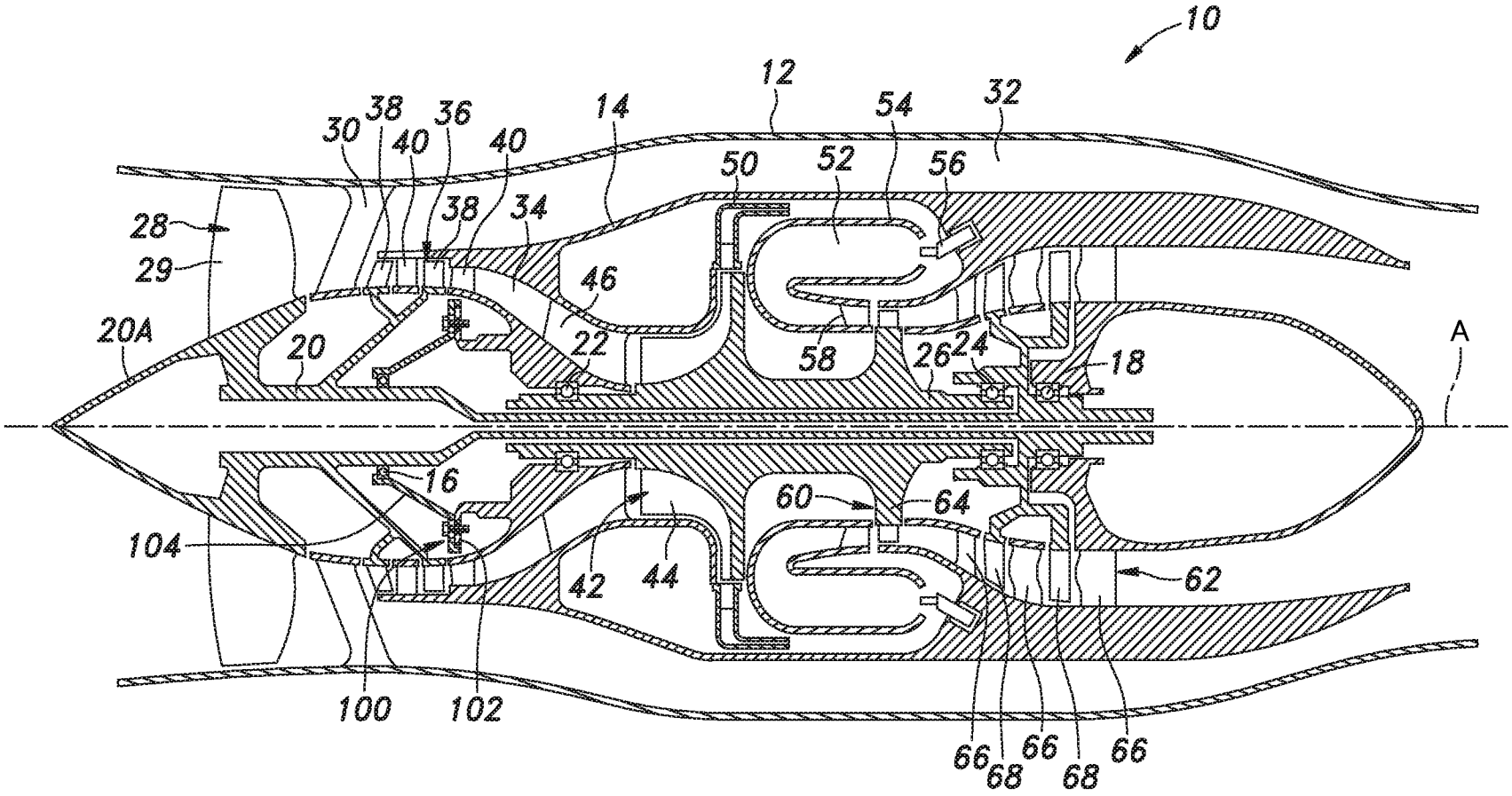
FIG. 1 is a sectional view showing an overall structure of an embodiment of a gas turbine engine according to the present invention.

As shown in FIG. 1, a gas turbine engine 10 is of a turbofan type and includes a substantially cylindrical outer casing 12 and an inner casing 14 that are arranged coaxially. The inner casing 14 rotatably supports a low pressure rotary shaft 20 therein via a front first bearing 16 and a rear first bearing 18. A tubular high pressure rotary shaft 26 is arranged so as to be rotatable around an outer circumference of an axially intermediate portion of the low pressure rotary shaft 20. The front portion of the high pressure rotary shaft 26 is supported by the inner casing 14 via a front second bearing 22 while the rear portion of the same is supported by the low pressure rotary shaft 20 via a rear second bearing 24. The low pressure rotary shaft 20 and the high pressure rotary shaft 26 are arranged coaxially, and the central axis thereof is denoted by a reference sign "A."

The low pressure rotary shaft 20 includes a substantially conical tip portion 20A that protrudes more forward than the inner casing 14. An outer circumference of the tip portion 20A is provided with a front fan 28 including multiple fan blades 29, which are made of titanium alloy or the like and arranged to be spaced apart from one another in the circumferential direction, such that the front fan 28 is rotatable around the central axis A within the outer casing 12.

Between the inner casing 14 and the front first bearing 16, a fuse mechanism 100 serving as a fail-safe mechanism at the time of FOD of the fan blades 29 or the like is provided, as will be described in detail later.

Multiple stator vanes 30, each having an outer end joined to the outer casing 12 and an inner end joined to the inner casing 14, are arranged on a downstream side of the front fan 28 so as to be spaced apart from one another at a predetermined interval in the circumferential direction. On a downstream side of the stator vanes 30, a bypass duct 32 defined between the outer casing 12 and the inner casing 14 to have an annular cross-sectional shape and an air compression duct (annular fluid passage) 34 defined coaxially (to be coaxial with the central axis A) in the inner casing 14 to have an annular cross-sectional shape are provided in parallel with each other.

An axial compressor 36 is provided in an inlet of the air compression duct 34. The axial compressor 36 includes two (front and rear) rotor blade rows 38 provided on an outer circumference of the low pressure rotary shaft 20 and two (front and rear) stationary blade rows 40 provided in the inner casing 14, such that the rotor blade rows 38 and the stationary blade rows 40 are arranged adjacent to each other and alternate in the axial direction.

A centrifugal compressor 42 is provided in an outlet of the air compression duct 34. The centrifugal compressor 42 includes impellers 44 provided on an outer circumference of the high pressure rotary shaft 26. A stationary blade row 46 is provided in the outlet of the air compression duct 34 on an upstream side of the impellers 44. Further, a diffuser 50 is provided at an outlet of the centrifugal compressor 42, wherein the diffuser is fixed to the inner casing 14.

On a downstream side of the diffuser 50, a combustion chamber member 54 is provided to define a reverse-flow combustion chamber 52 to which compressed air is supplied from the diffuser 50. The inner casing 14 is provided with multiple fuel injection nozzles 56 for injecting fuel into the reverse-flow combustion chamber 52. The reverse-flow combustion chamber 52 produces high-pressure combustion gas by combusting air-fuel mixture therein. A nozzle guide vane row 58 is provided in an outlet of the reverse-flow combustion chamber 52.

On a downstream side of the reverse-flow combustion chamber 52, a high pressure turbine 60 and a low pressure turbine 62 are provided such that the combustion gas produced in the reverse-flow combustion chamber 52 is blown thereto. The high pressure turbine 60 includes a high pressure turbine wheel 64 fixed to an outer circumference of the high pressure rotary shaft 26. The low pressure turbine 62 is provided on a downstream side of the high pressure turbine 60 and includes multiple nozzle guide vane rows 66 fixed to the inner casing 14 and multiple low pressure turbine wheels 68 provided on an outer circumference of the low pressure rotary shaft 20 arranged in an axially alternating manner.

At the start of the gas turbine engine 10, a starter motor (not shown in the drawings) drives the high pressure rotary shaft 26 to rotate. Once the high pressure rotary shaft 26 starts rotating, the air compressed by the centrifugal compressor 42 is supplied to the reverse-flow combustion chamber 52, and air-fuel mixture combustion takes place in the reverse-flow combustion chamber 52 to produce combustion gas. The combustion gas is blown to the high pressure turbine wheel 64 and the low pressure turbine wheels 68 to rotate the turbine wheels 64, 68.

Thereby, the low pressure rotary shaft 20 and the high pressure rotary shaft 26 rotate, which causes the front fan 28 to rotate and brings the axial compressor 36 and the centrifugal compressor 42 into operation, whereby the compressed air is supplied to the reverse-flow combustion chamber 52. Therefore, the gas turbine engine 10 continues to operate after the starter motor is stopped.

During the operation of the gas turbine engine 10, part of the air suctioned by the front fan 28 passes through the bypass duct 32 and is blown out rearward, and generates the main thrust particularly in a low-speed flight. The remaining part of the air suctioned by the front fan 28 is supplied to the reverse-flow combustion chamber 52 and mixed with the fuel and combusted, and the combustion gas is used to drive the low pressure rotary shaft 20 and the high pressure rotary shaft 26 to rotate before being blown out rearward to generate thrust.

Figure 2:
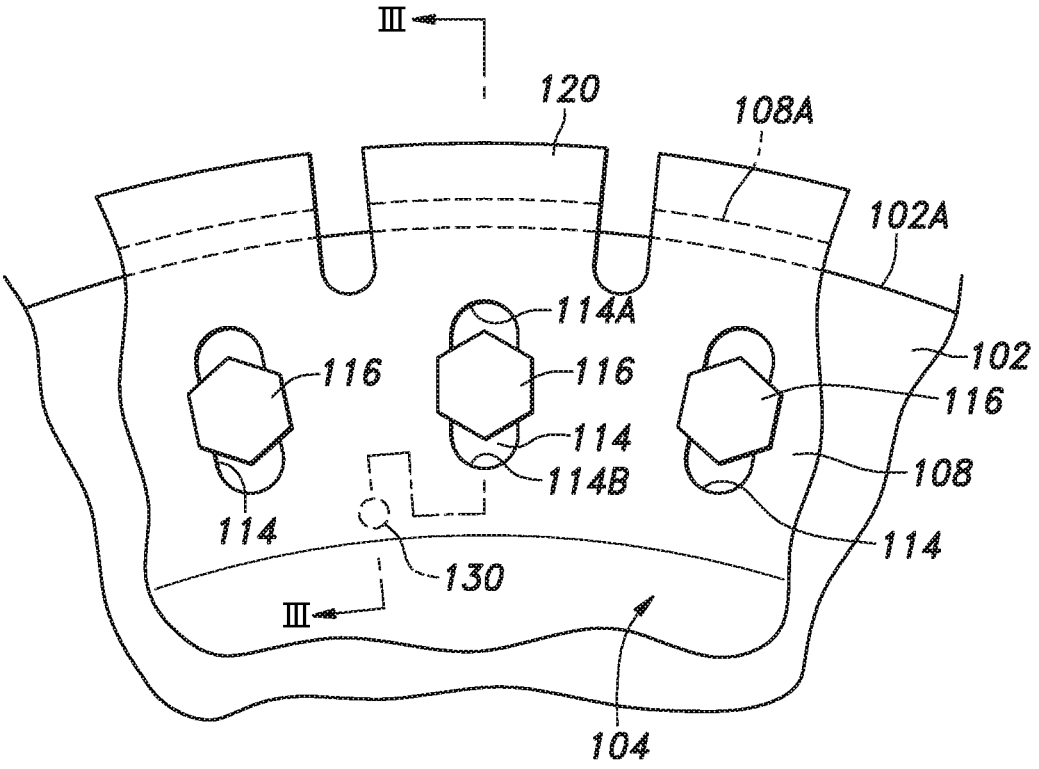
FIG. 2 is a front view of an essential part (fuse structure) of the gas turbine engine.

Next, the fuse mechanism 100 will be described in detail primarily with reference to FIGS. 2 to 4.

The inner casing (engine case) 14 integrally includes a first flange 102 that extends annularly around the outer circumference of the low pressure rotary shaft 20 coaxially with the low pressure rotary shaft 20. The first flange 102 extends from an inner surface of the inner casing 14 in a direction perpendicular to the central axis A of the low pressure rotary shaft 20 (see FIG. 1), and defines a first annular contact surface (flange surface) 103 facing in the axial direction.

A bearing case 104 having a hollow, truncated conical shape is disposed around the outer circumference of a front part of the low pressure rotary shaft (engine rotation shaft) 20 coaxially with the low pressure rotary shaft 20. The bearing case 104 includes a cylindrical, small-diameter end portion (inner end) 106 supporting the front first bearing (bearing member) 16 on a small-diameter side (truncated side) thereof and a large-diameter end portion (outer end) 110 forming an annular second flange 108 on a large-diameter side thereof. The second flange 108 is disposed in front of the first flange 102 and extends in the direction perpendicular to the central axis A of the low pressure rotary shaft 20 (see FIG. 1), and defines a second annular contact surface 109 facing in the axial direction. The second annular contact surface 109 (flange surface) faces the first annular contact surface 103 in the axial direction and coaxially contacts the first annular contact surface 103.

At multiple positions of the first flange 102 in the circumferential direction, first bolt through-holes 112 are formed to extend through the first flange 102 such that each of the first bolt through-holes 112 consists of a circular hole having a substantially same diameter as that of later-described bolts 116. At multiple positions of the second flange 108 in the circumferential direction, second bolt through-holes 114 are formed to extend through the second flange 108, where each of the second bolt through-holes 114 consists of an oblong hole that is oblong in a radial direction and is aligned with the corresponding one of the first bolt through-holes 112 in the circumferential direction.

Bolts 116 are axially passed through the respective first bolt through-holes 112 and the respective second bolt through-holes 114, and nuts 118 are fastened to the respective bolts 116. Thereby, the second flange 108 and the first flange 102 are joined to each other so as to be relatively movable in the radial direction within a range determined by the oblong second bolt through-holes 114 when the second flange 108 is applied with a load greater than or equal to a first predetermined value in a direction to move the second flange 108 radially relative to the first flange 102. The first predetermined value is determined by a fastening force exerted by the bolts 116 and the nuts 118.

Figure 3:
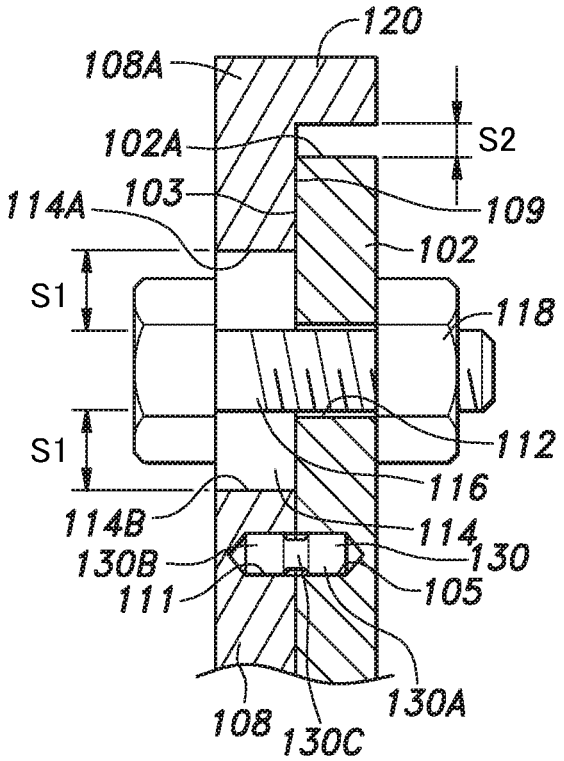
FIG. 3 is a sectional view taken along line in FIG. 2.

In a steady state in which the second flange 108 is not applied with a load greater than or equal to the first predetermined value in a direction to move the second flange radially relative to the first flange 102, as shown in FIG. 3, the center of each bolt 116 is positioned at a lengthwise center of the corresponding second bolt through-hole 114. In this initial state position (neutral position), a same first gap S1 is radially formed between each bolt 116 and an outer end (outer end in the radial direction of the first flange 102) 114A of the corresponding second bolt through-hole 114 and between each bolt 116 and an inner end (inner end in the radial direction of the first flange 102) 114B of the corresponding second bolt through-hole 114.

The large-diameter end portion 110 includes an opposing piece 120. The opposing piece 120 is an annular bent piece that is bent rearward 90 degrees from an outer circumferential edge 108A of the second flange 108 to extend axially, such that the opposing piece 120 radially opposes an outer circumferential surface 102A defining the outer circumferential edge of the first flange 102 via a second gap S2. In the aforementioned steady state, the second gap S2 is smaller than the first gap S1 (S1>S2).

Namely, an amount of radial play produced between the first flange 102 and the second flange 108 when a load greater than or equal to the first predetermined value is applied on the second flange 108 to overcome the fastening force exerted by the bolts 116 and the nuts 118 is greater than the second gap S2.

The first flange 102 is formed with a first pinhole 105 that opens out in the first annular contact surface 103. The second flange 108 is formed with a second pinhole 111 that opens out in the second annular contact surface 109. The first pinhole 105 and the second pinhole 111 are aligned with each other (or squarely face each other) when the first flange 102 and the second flange 108 are in the initial state position, as shown in FIG. 3. The first pinhole 105 receives one end of a shear pin 130 and the second pinhole 111 receives another end of the shear pin 130.

The shear pin 130 has a large-diameter portion 130A at the one end thereof and another large-diameter portion 130B at the other end thereof, and the large-diameter portions 130A and 130B are connected by a small-diameter portion 130C having a diameter smaller than those of the large-diameter portions 130A, 130B. With the large-diameter portion 130A inserted into the first pinhole 105 and the large-diameter portion 130B inserted into the second pinhole 111, the first flange 102 and the second flange 108 are positioned relative to each other.

When the second flange 108 is applied with a load greater than or equal to a second predetermined value in a direction to move the second flange radially relative to the first flange 102, the shear pin 130 breaks due to shear of the small-diameter portion 130C. Namely, the shear strength of the small-diameter portion 130C is set by appropriately selecting various factors such as the outer diameter thereof so that the small-diameter portion 130C fails in shear when the second flange 108 is applied with a load greater than or equal to the second predetermined value in a direction to move the second flange radially relative to the first flange 102. The second predetermined value may be equal to the first predetermined value or slightly smaller than the first predetermined value.

In the steady state in which the second flange 108 is not applied with a load greater than or equal to the second predetermined value in a direction to move the second flange radially relative to the first flange 102, the shear pin 130 prevents misalignment between the first flange 102 and the second flange 108 to define the initial state position of the first flange 102 and the second flange 108 uniquely, and prevents the second flange 108 from moving undesirably relative to the first flange 102 in the steady state. When the second flange 108 is applied with a load greater than or equal to the second predetermined value in a direction to move the second flange radially relative to the first flange 102, the shear pin 130 breaks to allow the second flange 108 to move relative to the first flange 102 in the radial direction. Therefore, the shear pin 130 does not hinder the function of the fuse mechanism 100.

Figure 4:
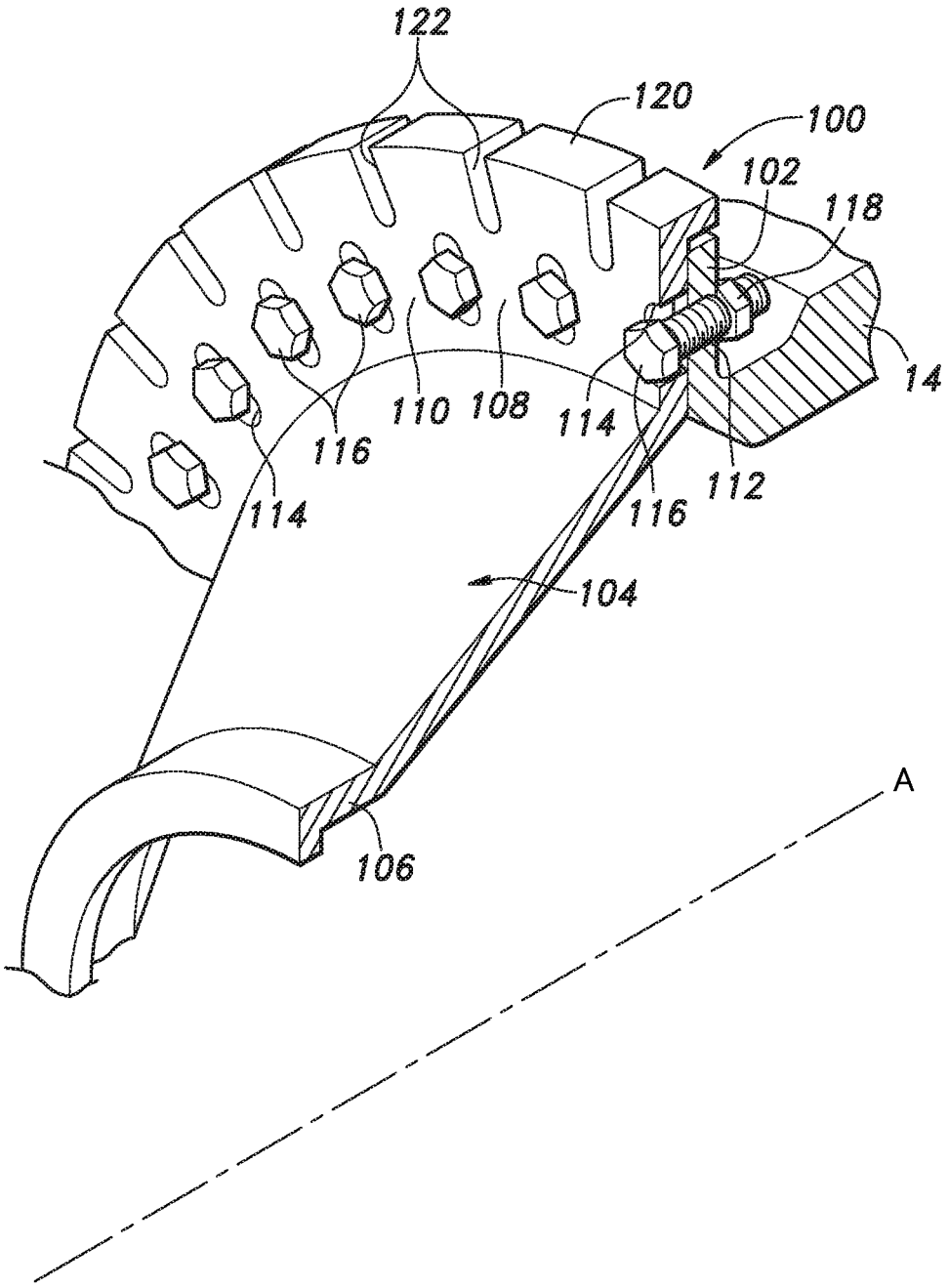
FIG. 4 is a perspective view of the essential part (fuse structure) of the gas turbine engine.

As best shown in FIG. 4, slit-shaped cutouts 122 are formed at multiple positions of the opposing piece 120 in the circumferential direction. Each cutout 122 extends into the outer edge of the second flange 108 connected to the opposing piece 120 as well as the vicinity thereof. The cutouts 122 divide the opposing piece 120 into multiple parts in the circumferential direction to reduce the bending stiffness of the opposing piece 120 in the radial direction. The degree of reduction in the bending stiffness of the opposing piece 120 is determined depending on the number of the cutouts 122 (circumferential pitch) and the dimensions (such as width, length, and thickness) of each cutout 122. The larger the number of the cutouts 122 is, and the larger the width, length, and thickness of each cutout 122 are, the greater the degree of reduction in the bending stiffness of the opposing piece 120 is.

In the steady state in which an imbalance load is not acting on the low pressure rotary shaft 20, the bearing load of the front first bearing 16 is transmitted from the bearing case 104 to the first flange 102 or to the inner casing 14 owing to frictional resistance (frictional engagement) between the first flange 102 and the second flange 108.

If a large imbalance load acts on the low pressure rotary shaft 20 at the time of FOD of the fan blades 29 or the like and the load acting on the second flange 108 overcomes the fastening force exerted by the bolts 116 and the nuts 118 (or the frictional resistance between the first flange 102 and the second flange 108 resulting from the fastening force), the second flange 108 moves radially relative to the first flange 102 against the frictional resistance. This relative radial movement absorbs (consumes) the energy of the imbalance load.

Along with the relative radial movement, the opposing piece 120 approaches the outer circumferential surface 102A of the first flange 102 and the second gap S2 decreases. As this radial movement proceeds further, the second gap S2 eventually becomes zero, and the opposing piece 120 comes into contact with and is pressed by the outer circumferential surface 102A of the first flange 102. This causes the opposing piece 120 to deform relative to the second flange 108, and the opposing piece 120 may eventually break away from the second flange 108. Owing to the deformation and breakage of the opposing piece 120, further absorption (consumption) of the energy of the imbalance load takes place.

Thus, when a large load acts at the time of FOD of the fan blades 29 or the like, the fuse mechanism 100 performs a fuse function to absorb (or consume) energy of the imbalance load, thereby minimizing damage to the gas turbine engine 10.

Because S1>S2, namely, because the amount of play produced in the radial direction between the first flange 102 and the second flange 108 is greater than the second gap S2, the deformation of the opposing piece 120 takes place in a state where the outer end 114A or the inner end 114B of each second bolt through-hole 114 is not in contact with the outer circumferential surface of the corresponding bolt 116, and therefore, it is ensured that when a large load acts, the bolts 116 do not break before the opposing piece 120 deforms.

Because the opposing piece 120 is a bent piece that is bent in the axial direction from the outer circumferential edge of the second flange 108, no special additional component is necessary to achieve the opposing piece 120. Further, by appropriately designing the cutouts 122, it is possible to provide the opposing piece 120 with a bending stiffness appropriate to serve as a fuse mechanism.

The fuse mechanism 100 is constituted at a joint between the inner casing 14 and the bearing case 104 supporting the front first bearing 16 provided near the front fan 28 without need for a large space or an additional member, and therefore, the fuse mechanism can be adopted in the gas turbine engine 10 without requiring an increase in the engine size and a change in the engine layout.

In the foregoing, the present invention has been described in terms of the preferred embodiment thereof, but the present invention is not limited to the foregoing embodiment and various alterations and modifications may be made as appropriate.

Figure 5:
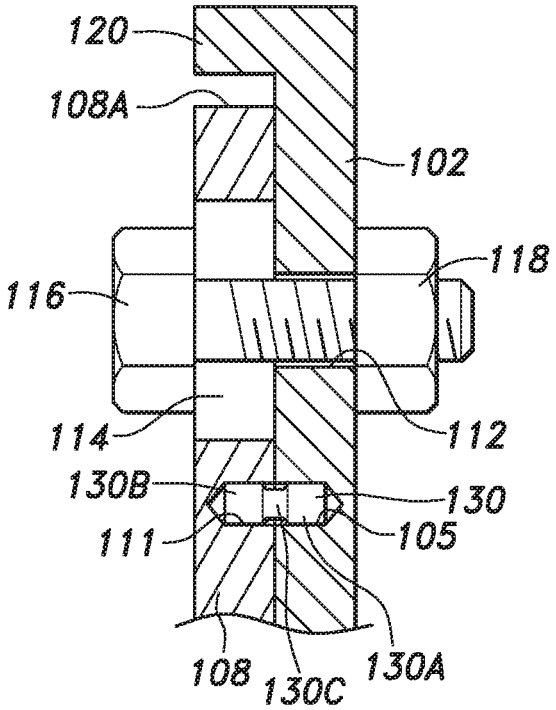
FIG. 5 is a sectional view of an essential part (fuse structure) of a gas turbine engine according to another embodiment.
Figure 6:
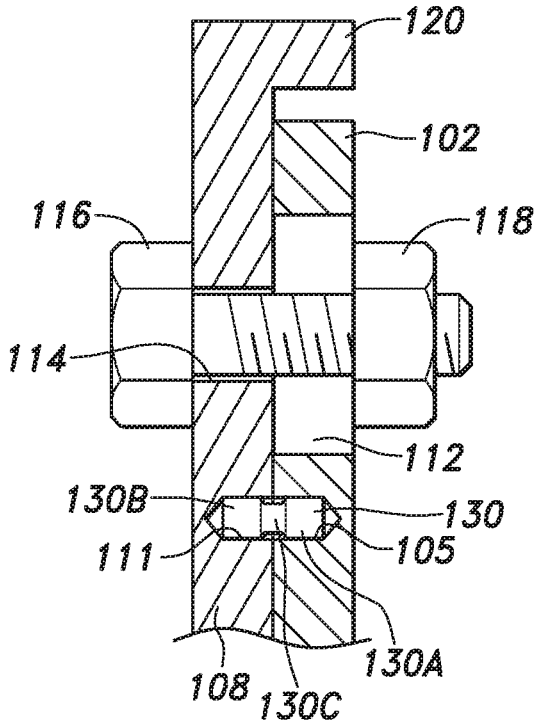
FIG. 6 is a sectional view of an essential part (fuse structure) of a gas turbine engine according to yet another embodiment.

For instance, as shown in FIG. 5, the opposing piece 120 may be provided at an outer edge of the first flange 102. As shown in FIG. 6, the first bolt through-holes 112 may be oblong holes that are oblong in the radial direction, and the second bolt through-holes 114 may be circular holes. Both the sets of the first bolt through-holes 112 and the second bolt through-holes 114 may be oblong holes. In this case, the length of each oblong hole can be half the length of the oblong hole in the case where either the first bolt through-holes 112 or the second bolt through-holes 114 are oblong holes. The joint between the first flange 102 and the second flange 108 may be performed ay any suitable fasteners other than the bolts 116 and the nuts 118, such as rivets. Also, if the opposing piece 120 in a cylindrical shape has an appropriate bending stiffness to exert a desired fuse function, the cutouts 122 may be omitted.

Also, not all of the structural elements shown in the above embodiment(s) are necessarily indispensable and they may be selectively used as appropriate without departing from the scope of the present invention.

The invention claimed is:

1. A gas turbine engine, comprising:

an engine case;

an engine rotation shaft rotatably supported by the engine case via a bearing;

a first flange extending from the engine case to define a first annular contact surface facing in an axial direction; and a bearing case having an inner end supporting an outer circumference side of the bearing and a second flange defining a second annular contact surface that coaxially contacts the first annular contact surface, wherein the second flange is joined to the first flange such that the second flange moves radially relative to the first flange when applied with a load greater than or equal to a first predetermined value in a direction to move the second flange radially relative to the first flange, and an outer circumferential edge of one of the first flange and the second flange is provided with an opposing piece that opposes an outer circumferential edge of another of the first flange and the second flange via a radial gap.

2. The gas turbine engine according to claim 1, wherein the opposing piece is formed of a bent piece that is bent from the outer circumferential edge of the one of the first flange and the second flange in the axial direction.

3. The gas turbine engine according to claim 1, wherein the opposing piece is divided into multiple parts in a circumferential direction by multiple cutouts provided at multiple positions in the circumferential direction.

4. The gas turbine engine according to claim 1, wherein the first flange and the second flange are joined to each other by means of bolts axially passed through bolt through-holes formed in each of the first flange and the second flange and nuts fastened to the respective bolts, and the bolt through-holes formed at least one of the first flange and the second flange are oblong holes that are oblong in a radial direction.

5. The gas turbine engine according to claim 4, wherein an amount of radial movement play produced between the first flange and the second flange when the load greater than or equal to the first predetermined value which is applied to the second flange overcomes a fastening force exerted by the bolts and the nuts is greater than a radial gap between the opposing piece and an outer circumferential edge of the other of the first flange and the second flange that opposes the opposing piece.

6. The gas turbine engine according to claim 1, wherein the first flange and the second flange are joined to each other by means of bolts axially passed through bolt through-holes formed in each of the first flange and the second flange and nuts fastened to the respective bolts, the bolt through-holes formed in one of the first flange and the second flange are oblong holes that are oblong in a radial direction, and the bolt through-holes formed in another of the first flange and the second flange are circular holes having a same diameter as that of the bolts.

7. The gas turbine engine according to claim 6, wherein an amount of radial movement play produced between the first flange and the second flange when the load greater than or equal to the first predetermined value which is applied to the second flange overcomes a fastening force exerted by the bolts and the nuts is greater than a radial gap between the opposing piece and an outer circumferential edge of the other of the first flange and the second flange that opposes the opposing piece.

8. The gas turbine engine according to claim 1, further comprising a shear pin that connects the first flange and the second flange in an initial state position and breaks when the second flange is applied with a load greater than or equal to a second predetermined value in a direction to move the second flange radially relative to the first flange, the second predetermined value being equal to or smaller than the first predetermined value.

* * * * *